US006918509B2

(12) United States Patent
Baker et al.

(10) Patent No.: US 6,918,509 B2
(45) Date of Patent: Jul. 19, 2005

(54) TOY AND POGO DISPENSER

(75) Inventors: Paul J. Baker, Saylorsburg, PA (US); David Schweitzer, Weston, CT (US); Lynn Briggs, Bristol, CT (US); Peter Weremchuk, South Windsor, CT (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 10/128,470

(22) Filed: Apr. 24, 2002

(65) Prior Publication Data

US 2003/0201277 A1 Oct. 30, 2003

(51) Int. Cl.[7] ..... G07F 11/16
(52) U.S. Cl. ..... 221/266; 221/263; 221/65
(58) Field of Search ..... 221/263, 266, 221/65

(56) References Cited

U.S. PATENT DOCUMENTS

| | | | | | |
|---|---|---|---|---|---|
| 2,134,180 | A | * | 10/1938 | Felber | 221/200 |
| 2,479,860 | A | | 8/1949 | Otis | 312/84 |
| 2,620,061 | A | | 12/1952 | Uxa | 206/42 |
| 2,705,576 | A | | 4/1955 | Amelio et al. | 221/232 |
| 2,853,206 | A | | 9/1958 | Uxa | 221/229 |
| 3,344,951 | A | | 10/1967 | Gervais | 221/7 |
| 3,471,056 | A | | 10/1969 | Kovac | 221/151 |
| 3,796,347 | A | | 3/1974 | Hafner | 221/276 |
| 4,295,579 | A | | 10/1981 | Haas | 221/229 |
| 4,415,098 | A | | 11/1983 | Haas | 221/202 |
| 4,653,668 | A | * | 3/1987 | Gibilisco et al. | 221/298 |
| 4,903,861 | A | | 2/1990 | Yuyama | 221/265 |
| 5,178,298 | A | | 1/1993 | Allina | 221/24 |
| 5,405,047 | A | * | 4/1995 | Hansen | 221/190 |
| 5,460,295 | A | | 10/1995 | Law | 221/185 |
| 5,542,570 | A | | 8/1996 | Nottingham et al. | 221/192 |
| 5,651,475 | A | | 7/1997 | Fenton | 221/24 |
| 5,673,813 | A | | 10/1997 | Russell | 221/203 |
| 5,874,119 | A | | 2/1999 | Coleman et al. | 426/104 |
| 6,176,391 | B1 | | 1/2001 | Rehkemper et al. | 221/8 |
| 6,206,235 | B1 | | 3/2001 | Green | 221/251 |
| 6,213,342 | B1 | | 4/2001 | Kinberg et al. | 221/24 |
| 6,244,463 | B1 | | 6/2001 | Richards et al. | 221/24 |
| 6,267,639 | B1 | | 7/2001 | Menow et al. | 446/81 |

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

A dispenser for dispensing candy or other small objects, the dispenser having a rotatable hopper, having a hopper cavity therein, a tubular structure, having a storage portion for storing objects above the rotating hopper, a storage portion opening, a base portion, a base portion opening for dispensing objects, and a hopper positioning portion, where the rotatable hopper is positioned within the hopper positioning portion of the tubular structure, such that the rotatable hopper can rotate within the hopper positioning portion of the tubular structure, a tubular base plunger, inserted into the base portion of the tubular structure, and a hopper rotation mechanism connecting the base plunger to the rotatable hopper, where the hopper rotation mechanism is configured to rotate the rotatable hopper when the base plunger is moved within the base portion of the tubular structure.

20 Claims, 4 Drawing Sheets

10

TOY AND POGO DISPENSER

BACKGROUND OF THE INVENTION

1. Field of the Invention

The present invention is generally directed to a dispenser for small objects, such as candy, pills, tablets and the like. In particular, the invention is directed to dispensers having a plunger that rotates a hopper to load the hopper and dispense an object.

2. Related Background Art

Dispensers for candy, tablets, pills, and other objects of similar size are well known in the art. Dispensers range from simple box-like containers to elaborate toys that also function as candy dispensers. Dispensers that utilize various mechanisms for dispensing an object from a storage container are also known in the art.

Known dispenser mechanisms include those designed to dispense a single tablet, pill, or piece of candy from a pre-loaded stack. For example, U.S. Pat. No. 4,295,579 to Haas. The disclosed dispenser includes a storage receptacle in which a spring is biased to press a stack of tablets stored within the receptacle towards the dispensing end of the receptacle, which is covered by a pivoting cover. The uppermost tablet is pressed by the spring and any tablets beneath it into a bridge over the top of the receptacle. The tablet is dispensed by pivoting the cover, causing a skirt on the cover to push the tablet from under the bridge, thereby allowing the tablet to be removed from the dispenser. Closing the cover allows the spring to press the stack of tablets, such that the next tablet in the stack is pushed into the dispensing position under the bridge.

U.S. Pat. No. 2,705,576 to Amelio et al. discloses a pill or tablet dispenser having a spring that biases a stack of tablets against a rotatable cap. The cap has at least one recess into which the uppermost tablet is received when the cap is rotated into the closed position. Rotating the cap by hand exposes the recess, which contains a pill from the top of the stack, which can then be removed. Rotating the cap back to the closed positions allows the spring to move the next pill in the stack to enter the recess to be dispensed the next time the cap is rotated.

Various novelty dispensers, particularly for candy, are also known in the art, and often take the form of toys. For example, U.S. Pat. No. 5,651,475 to Fenton discloses a candy dispenser in the form of an animal. Pivoting the head of the animal pulls on a sliding gate, opening a hole in the body of the animal to allow candy or other items to be dispensed. Pushing back on the head slides the gate to its original position to cover the hole in the body, and prevent further items from being dispensed.

U.S. Pat. No. 6,244,463 B1 to Richards et al. discloses a candy dispenser in the form of a toy spacecraft. The dispenser includes an internal cavity for storing candy. Pressing on a button on the spacecraft, which may be in the form of a passenger, retracts a hammer against a spring, unblocking an aperture in the bottom of the cavity, and allowing a piece of candy to fall into a firing chamber. When the button is pressed beyond a certain point, the hammer is released, and driven into the candy by the spring, so that the candy is dispensed as if fired from the spacecraft.

U.S. Pat. No. 6,267,639 to Menow et al. discloses a candy dispenser that produces simulated laughing sounds. Pulling on a trigger on the dispenser causes a flywheel to rotate, which moves the head and tail of a simulated animal on top of the dispenser, and causes a reed to vibrate to produce the desired sound. Pulling fully on the trigger also causes a slide valve, positioned under a candy storage cavity, to move forward. The slide valve has an opening that accepts a single piece of candy from the storage cavity. When the slide valve is moved forward by the trigger, the opening in the slide valve moves over a ramp and the exit of the container. As a result, pulling fully on the trigger releases a single piece of candy. When the trigger is released, a new piece of candy falls into the hole in the slide valve to be dispensed when the trigger is next pulled fully.

U.S. Pat. No. 6,213,342 B1 to Kinberg et al. discloses a candy dispenser that simulates a candy factory. The dispenser includes a rotatable cradle, disposed in the discharge path of the dispenser, and operatively connected to a motor by a gear train that repetitively rotates the cradle from a first position in which the cradle prevents the passage of candy through the dispensing opening to a second position in which the cradle permits passage of the candy from the loading chamber to the dispensing position. The repetitive rotation of the cradle dispenses a series of pieces of candy.

No known dispenser functions by simply pressing the dispenser onto a surface such a table or the users hand, or, equivalently, by pressing on the base of the dispenser. The present invention provides such a dispenser.

SUMMARY OF THE INVENTION

The present invention is directed to a dispenser for dispensing candy or other objects of similar size. The dispenser of the invention comprises a rotatable hopper, a tubular structure, comprising one of a tube or a plurality of interconnected tubes, a tubular base plunger, and a hopper rotation mechanism functionally connecting the base plunger to the rotatable hopper. The hopper has an axis of rotation and an outer surface, and defines a hopper cavity. The tubular structure comprises a storage portion for storing objects above the rotatable hopper, a base portion, defining a base portion opening for dispensing objects, and a hopper positioning portion between the storage portion and the base portion. The tubular base plunger is inserted into the base portion of the tubular structure. The rotatable hopper is positioned within the hopper positioning portion of the tubular structure, such that the rotatable hopper can rotate around the hopper axis of rotation within the hopper positioning portion of the tubular structure, and the hopper rotation mechanism is configured to rotate the rotatable hopper when the base plunger is moved within the base portion of the tubular structure. Preferably, the hopper rotation mechanism comprises a pinion gear, attached to the rotatable hopper, and a rack attached to the base plunger, and functionally mated to the pinion gear, thereby forming a rack and pinion. The pinion gear has an axis of rotation coincident with that of the of the hopper.

Each of the rotatable hopper and the base plunger have a hopper cup filling position and a dispensing position, such that, when the base plunger is moved within the tubular structure from the hopper cup filling position of the base plunger to the base plunger dispensing position, the hopper rotation mechanism rotates the rotatable hopper from the hopper cup filling position, in which the hopper cavity is generally directed towards the tubular structure storage portion, to the hopper dispensing position, in which the hopper cavity is generally directed towards the tubular structure base portion opening. Similarly, when the base plunger is moved within the tubular structure from the base plunger dispensing position to the hopper cup filling position of the base plunger, the hopper rotation mechanism rotates the rotatable hopper from the hopper dispensing position to the hopper cup filling position.

Preferably, the dispenser further comprises a base plunger return mechanism, which is either configured to move the base plunger from the dispensing position to the hopper cup filling position, thereby rotating the rotatable hopper from the hopper dispensing position to the hopper cup filling position, or to move the base plunger from the hopper cup filling position to the dispensing position, thereby rotating the rotatable hopper from the hopper cup filling position to the hopper dispensing position.

DETAILED DESCRIPTION OF THE INVENTION

As used herein, the terms "tube" and "tubular structure" refer to any hollow object or structure having an interior volume and an opening at each end of the tube or tubular structure that allows access into the hollow interior, such that an object of the appropriate size can pass into the opening at one end, through the interior volume, and out the opening at the other end. Tubes and tubular structures may have any appropriate cross-sectional area or shape, and each of the cross-sectional area and shape may vary independently along the length of the tube or tubular structure to form any shape or size required in the invention. Moreover, the internal cross-sectional shape of the tube or tubular structure may be different from the external cross-sectional shape of the tube. For example, the internal and external cross-sectional shapes of a tube may independently be any regular or irregular geometrical shape, including, but not limited to, a circle, ellipse, square, rectangle, or rectangle. Where a tubular portion of a dispenser of the invention is in the shape of a toy, such as, e.g., a figure or a machine, the external cross-sectional shape of the tube at any point along its length will be that of the toy at that point. Tubular structures may comprise a single tube, or may be formed from a plurality of interconnected tubes. Moreover, individual tubes may be formed from a single piece or from a plurality of interconnected pieces.

The present invention is directed to candy, pill, and tablet dispensers and to dispensers for other objects of similar size, such as, e.g., screws, nuts, bolts, and other small mechanical or electrical parts. In the most preferred embodiment, the present invention is directed to a combination candy dispenser and toy. Dispensers in accordance with the invention may be made from any useful material known in the art, such as, e.g., a molded plastic material. The material may be opaque or translucent, but is preferably a clear or tinted transparent material.

Figure 1:
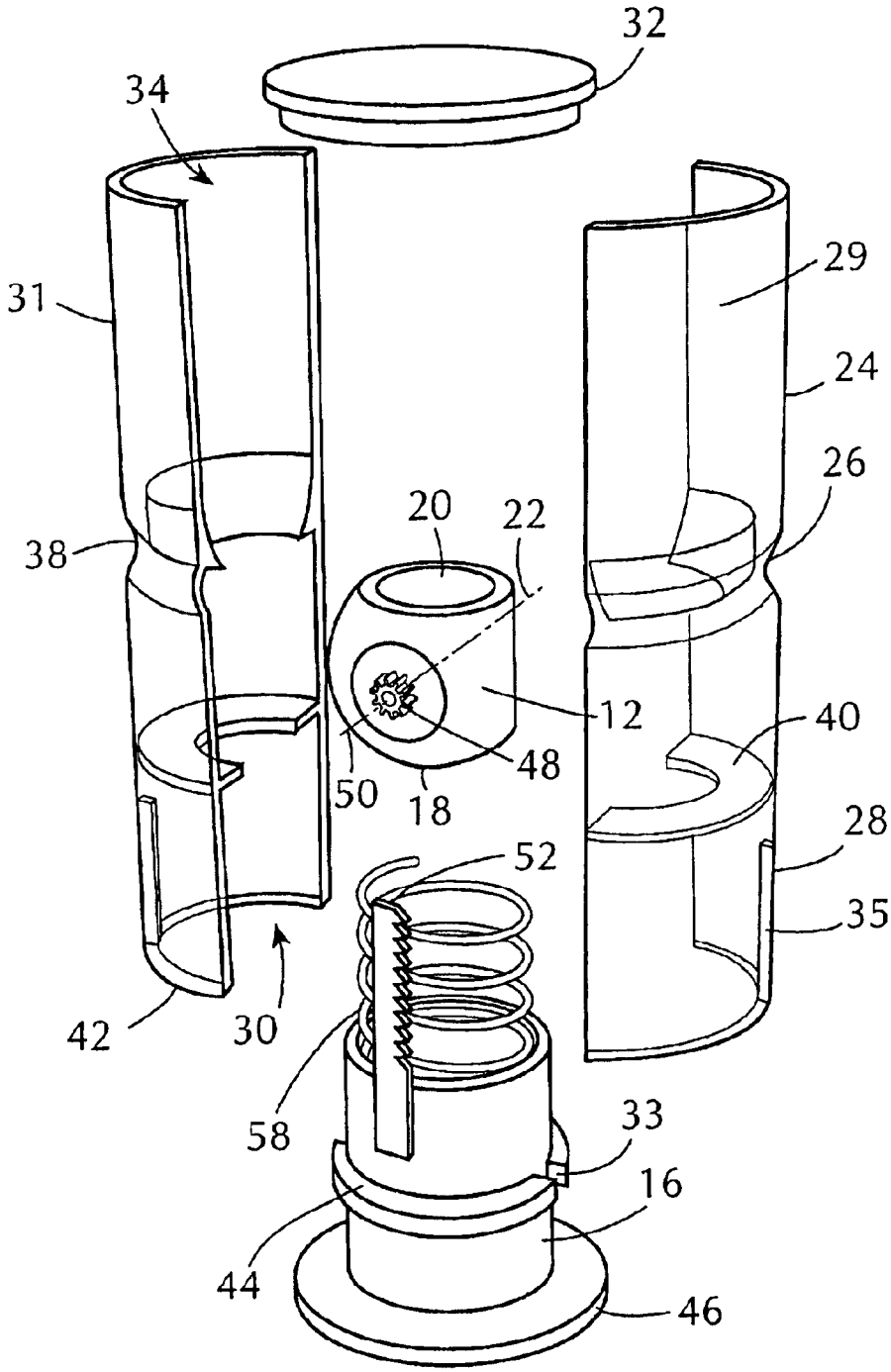
FIG. 1 is an exploded view of a first embodiment of a dispenser of the invention.
Figure 2:
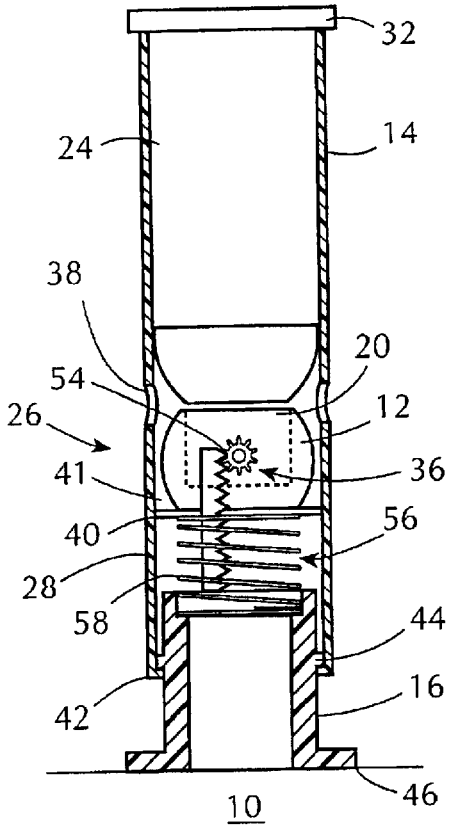
FIG. 2 is an illustration of the first embodiment of the dispenser of the invention in the rest position.
Figure 3:
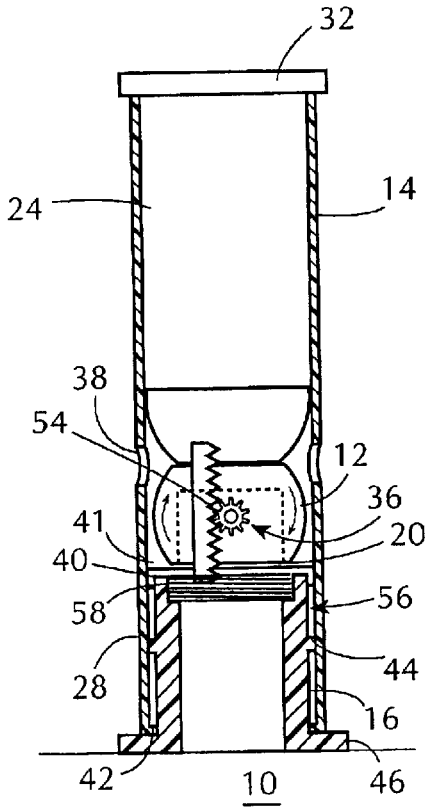
FIG. 3 is an illustration of the first embodiment of the dispenser of the invention in the dispensing position.

A dispenser 10 in accordance with one embodiment of the present invention is generally illustrated in FIGS. 1 to 3, where FIG. 1 is an exploded view, FIG. 2 illustrates dispenser 10 in the rest position, which, in the illustrated embodiment, is also the hopper cup filling position, and FIG. 3 illustrates dispenser 10 in the compressed position, which, in the illustrated embodiment, is also the dispensing position.

Dispenser 10 comprises a rotatable hopper 12, a hollow tubular structure formed from a single tube 14, and a tubular or hollow base plunger 16. Rotatable hopper 12 has an outer surface 18 and a cup 20 that extends through outer surface 18 into the interior of hopper 12. Rotatable hopper 12 also has an axis of rotation 22 around which hopper 12 rotates to dispense candy or other small objects. Cup 20 is of a sufficient size to contain at least one of the objects to be dispensed. Rotatable hopper 12 preferably has a cross section perpendicular to rotational axis 22 that is, at least in part, substantially circular, and is most preferably, at least in part, spherical or cylindrical. As will be understood by those of skill in the art, the presence of cup 20 prevents hopper 12 from having a completely circular cross section in that portion of hopper 12 where cup 20 is present. However, rotatable hopper 12 may be of any shape that allows the hopper to be rotated freely within tube 14. In addition, as illustrated in FIGS. 1 to 3, tube 14 and base plunger 16 each have a circular cross section along the length of dispenser 10. However, as will be understood by those of ordinary skill in the art, tube 14 and base plunger 16, and, thus, dispenser 10, each may have any cross sectional shape and size that may vary along the length of dispenser 10, as long as the shape and size of the cross section allows dispenser 10 to function.

Tube 14 comprises a storage portion 24 for storage of candy or other objects, which may be stacked or randomly placed in storage portion 24, a hopper positioning portion 26, and a base portion 28 for dispensing candy or other objects through a base portion opening 30. Preferably, tube 14 is formed from two separately molded halves 29 and 31 that are joined to form tube 14. Optionally, a removable cap 32 may be used to cover a storage portion opening 34. Preferably, cap 32 may be removed to place candy or other objects into tube storage portion 24 for storage prior to being dispensed. As discussed below, cap 32, may also function as a toy, having the form of an animal, character, or machine, or form a portion of a toy or a base for a toy. Where the cap forms a base for a toy, the toy may be fixedly attached to the base or removable.

Hopper positioning portion 26 is configured to position rotatable hopper 12 between tube storage portion 24 and base portion 28, while allowing hopper 12 to freely rotate within tube 14 when actuated by a hopper rotation mechanism 36. Optionally, hopper 12 may be further positioned within hopper positioning portion 26 by one or more pins (not shown) that are formed or mounted coincident with axis of rotation 22 in, on, or through hopper positioning portion 26 to provide smooth rotation of hopper 12.

As will be recognized by those skilled in the art, rotatable hopper 12 and hopper positioning portion 26 should be shaped to prevent one or more pieces of candy or other objects to be dispensed from becoming jammed between tube 14 and hopper surface 18. In the embodiment of the invention illustrated in FIGS. 1 to 3, hopper positioning portion 26 preferably comprises at least one of a tube constriction 38, a tube flange 40, or a combination thereof to position hopper 12, and to prevent candy or other objects from entering the clearance space 41 between hopper 12 and tube 14.

Base plunger 16 is generally tubular, and is positioned within tube base portion 28 in a manner that allows base plunger 16 to slide over a range of motion within tube base portion 28. The range of motion of base plunger 16 may be limited by tube stops 42 within tube base portion opening 30 that interact with base plunger stops 44 and 46 on base plunger 16 to prevent base plunger 16 from being pushed too far within or falling out of tube base portion 30. The motion of base plunger 16 may be controlled by a guide formed from, e.g., a slot or groove 33 in base plunger 16 and a pin or ridge 35 on the interior of base portion 28, as illustrated in FIG. 1. As will be recognized by those of ordinary skill in the art, the positions of groove 33 and ridge 35 may be reversed. That is slot or groove 33 may be provided in base portion 28, and pin or ridge 35 may be provided on base plunger 16.

Moreover, such a guide may be used to eliminate the need for tube stop 42 and base plunger stops 44 and 46. For example, if slot or groove 33 in either of base plunger 16 or base portion 28 is of the proper length, and has properly defined ends that can act as stops, pin or ridge 35 in base portion 28 or base plunger 16 will limit the motion of base plunger 16 to the desired range of motion. Pin or ridge 35 may be an integral part of base plunger 16 or base portion 28, or may be a separate piece mounted in, on, or through base plunger 16 or base portion 28.

Base plunger 16 and rotatable hopper 12 are functionally connected, i.e., operatively engaged, by rotation mechanism 36, which rotates rotatable hopper 12 in response to motion of base plunger 16 through its range of motion. In the preferred embodiment, base plunger 16 is fully inserted into tube base portion 28 when dispenser 10 is in the dispensing position illustrated in FIG. 3, and is at least partially withdrawn from tube base portion 28 when dispenser 10 is in the hopper cup filling position illustrated in FIG. 2. However, as will be recognized by those skilled in the art, if base plunger 16 is of a sufficient length, full insertion of base plunger 16 into tube base portion 28 is not required to place dispenser 10 into the dispensing position. Moreover, the relationship between the position of base plunger 16 and that of hopper 12 may be reversed by a modification of rotation mechanism 36 or by assembling dispenser 10 with rotatable hopper 12 inverted, i.e., with cup 20 directed to the base portion 28 rather than the storage portion 24.

In a preferred embodiment, dispenser 10 is assembled with rotatable hopper 12 positioned such that cup 20 is directed up and into tube storage portion 24, and base plunger 16 is at least partially withdrawn from tube base portion 28, as shown in FIG. 2. This allows at least one piece of candy or other object to be dispensed to enter cup 20. Sliding base plunger 16 further into tube base portion 28 causes rotation mechanism 36 to rotate rotatable hopper 12 as shown by the arrows in FIG. 3. Inserting base plunger 16 a sufficient distance into tube base portion 28 causes rotatable hopper 12 to rotate to a dispensing position in which cup 20 is directed down into tube base portion 28, allowing any objects within cup 20 to fall through tube base portion 28 and base plunger 16 to be dispensed. Returning base plunger 16 to the partially extended position rotates rotatable hopper 12 back to the rest position, so that cup 20 again is directed generally upwards, and one or more pieces of candy or other objects to be dispensed may enter cup 20.

As noted above, assembling dispenser 10 with rotatable hopper inverted, i.e., with cup 20 directed towards the tube base portion 28, reverses the operation of dispenser 10. As a result, in this embodiment, inserting base plunger 16 a sufficient distance into base portion 28 rotates hopper 12 into the hopper cup filling position, and returning base plunger 16 to the rest position rotates hopper 12 into the dispensing position. In this embodiment, an object is dispensed by first inserting base plunger 16 into tube base portion 28 to rotate rotatable hopper 12 to the hopper cup filling position, allowing at least one piece of candy or other object to enter cup 20, and then returning base plunger 16 to the at least partially withdrawn position to rotate rotatable hopper 12 back to the dispensing position.

Rotation mechanism 36 may be any mechanism know in the art that will cause rotatable hopper 12 to rotate in response to movement of base plunger 16 relative to base portion 28. Preferably, rotation mechanism 36 comprises a pinion gear 48 attached to hopper 12, where pinion gear 48 has an axis of rotation 50 that is coincident with hopper axis of rotation 22. Rotation mechanism 36 further comprises a rack 52 connected to base plunger 16, and functionally mated to pinion gear 48 to provide a rack and pinion 54. Thus, when base plunger 16 is moved, rack 52 interacts with pinion gear 48, rotating pinion gear 48 and rotatable hopper 12.

As will be recognized by those skilled in the art, a variety of other simple mechanical devices may be used as rotation mechanisms in the present invention. For example, rack and pinion 54 may be replaced with a friction wheel and a friction rod that is attached to base plunger 16 and functionally associated with the friction wheel. Friction between the friction wheel and the friction rod will cause rotatable hopper 12 to rotate in response to movement of base plunger 16.

Preferably, dispenser 10 further comprises a base plunger return mechanism 56 that comprises a resilient element, such as a spring 58 or other resilient mechanism that will return base plunger 16 to the rest position. Most preferably spring 58 is a coil spring, which may be positioned between base plunger 16 and tube flange 40 as illustrated in FIGS. 1 to 3. In this embodiment, spring 58 is positioned between base plunger 16 and tube hopper portion 26. Movement of base plunger 16 into tube base portion 28 compresses spring 58, such that when the force used to move base plunger 16 into tube base portion 28 is released, base plunger 16 and tube 14 are returned to the rest position. As will be recognized by those of skill in the art, movement of base plunger 16 into tube base portion 28 may be accomplished by holding tube 14 motionless, and moving base plunger 16; by holding base plunger 16 motionless and pressing tube 14 down over base plunger 16; or by moving base plunger 16 or tube 14 together.

Figure 4:
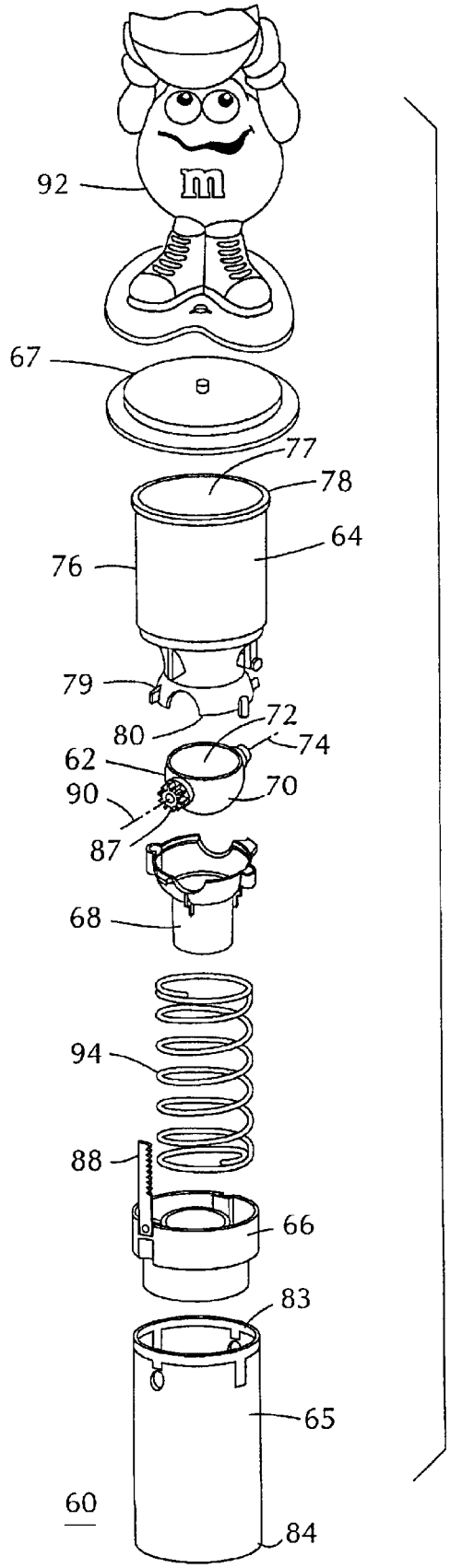
FIG. 4 is an exploded view of a further embodiment of a dispenser of the invention.
Figure 5:
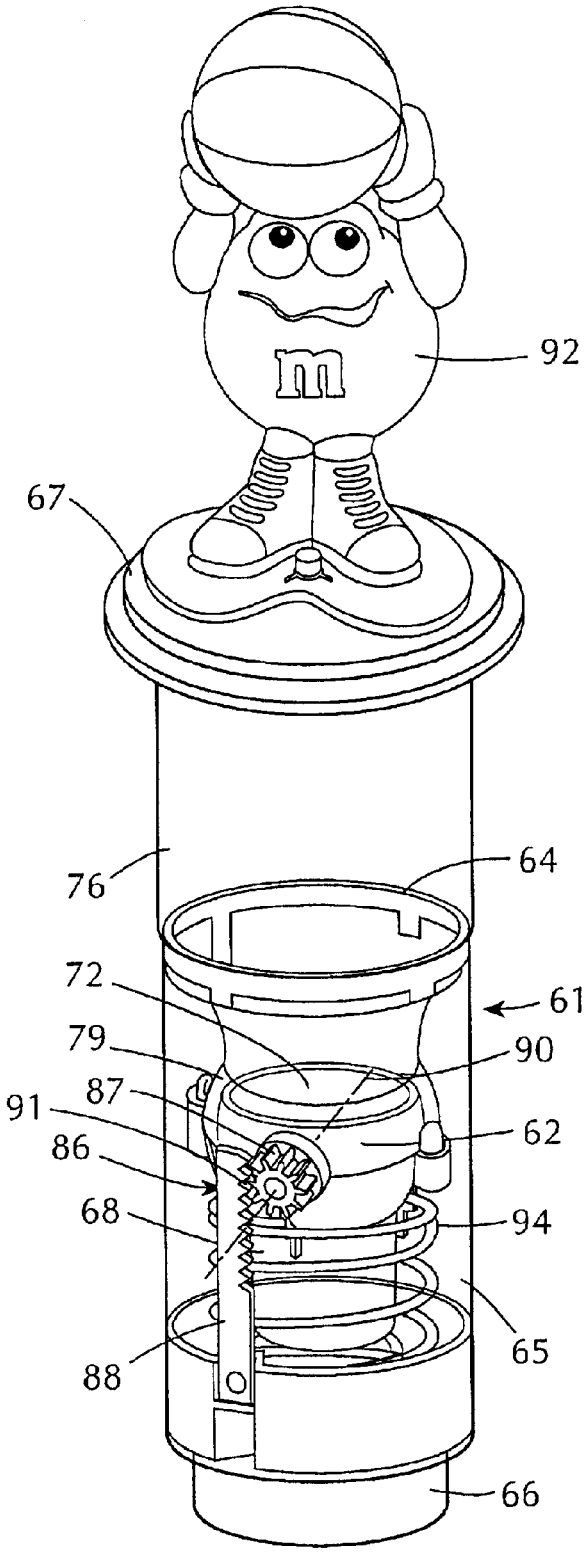
FIG. 5 is an illustration of the dispenser illustrated in FIG. 4 in the rest position.

A further embodiment of a dispenser of the invention is illustrated in FIGS. 4 and 5, where FIG. 4 is an exploded view, and FIG. 5 illustrates the embodiment in the rest position. Dispenser 60 comprises a tubular structure 61 and a rotatable hopper 62, where tubular structure 61 comprises hollow upper and lower dispenser tubes 64 and 65, a hollow base plunger 66, a tubular hollow hopper securing device 68. Rotatable hopper 62 is substantially the same as rotatable hopper 12, illustrated in FIGS. 1 to 3, having an outer surface 70, a cup 72, and an axis of rotation 74.

Upper dispenser tube 64 comprises a storage portion 76, defining an inner storage volume 77 at upper end 78 of upper tube 64, and a hopper positioning portion 79 at lower end 80 of the upper tube. Rotatable hopper 62 is secured to hopper positioning portion 79 by a tubular hopper securing piece 68 in a manner that allows hopper 62 to rotate freely. Optionally, dispenser 60 further comprises a cap 67 for maintaining objects within storage portion 76 prior to their being dispensed Lower end 80, rotatable hopper 62, and tubular securing piece 68 are positioned within the upper end 83 of lower dispenser tube 65, and base plunger 66 is positioned within the lower end 84 of lower tube 65, such that upper dispenser tube 64, lower tube 65, base plunger 66, and securing device 68 form a single tubular structure 61. As a result, in the absence of rotatable hopper 62, an object placed into storage position 76 would fall through hopper securing piece 68, lower dispenser tube 65, and base plunger 66. As with the embodiment illustrated in FIGS. 1 to 3, hopper 62 may be further positioned between lower end 80 and tubular securing piece 68 by one or more pins (not shown) that are formed or mounted coincident with axis of rotation 72 to provide smooth rotation of hopper 12. Moreover, the motion of base plunger 66 may be guided in the manner described above for the embodiment illustrated in FIGS. 1 to 3.

Dispenser 60 further comprises a hopper rotation mechanism 86 that is substantially the same as hopper rotation mechanism 36, illustrated in FIGS. 1 to 3. As with hopper rotation mechanism 36, illustrated in FIGS. 1 to 3, rotation mechanism 86 preferably comprises a pinion gear 87 attached to hopper 62, where pinion gear 87 has an axis of rotation 90 that is coincident with hopper axis of rotation 74. Preferably, rotation mechanism 86 further comprises a rack 88 connected to base plunger 66, and functionally mated to pinion gear 87 to provide a rack and pinion 91. As with the embodiment illustrated in FIGS. 1 to 3, this embodiment includes a base plunger return mechanism, comprising spring 94.

As noted above, in the most preferred embodiment of the present invention, the dispenser or a portion of the dispenser is also a toy, which may take the form of a figure, such as a stuffed animal, doll, toy soldier, cartoon character, holiday item, sport figure, sport equipment or the like, or of a machine, such as an airplane, spaceship, car, truck or the like. Either of the tubular structure or the cap may take the form of the toy. Where the cap is in the form of a toy, the toy may either sit on top of the tubular structure, or may at least partially surround the tubular structure. Where the tubular structure is in the form of a toy, the cap will preferably be part of the toy, such as the head of a doll or the door of a vehicle to allow filling the storage portion. As illustrated in FIGS. 4 and 5, cap 67 forms a base for toy 92.

Operation of the dispenser of the invention in a preferred embodiment is as follows: Preferably, the dispenser is assembled so that the rest position has the rotatable hopper positioned with the cup directed upwards in the hopper cup filling position. Pressing the base plunger and the tubular structure together by pressing the base plunger while holding the tubular structure, by pressing the tubular structure down over the base plunger, or by pressing both together compresses the return spring and moves the rack along the pinion gear to rotate the pinion gear and the hopper. When candy or other objects to be dispensed are stored in the storage portion of the tubular structure, one or more pieces of candy or objects to be dispensed will have entered the cup in the hopper during storage. Rotation of the hopper redirects the cup towards the base portion of the tubular structure, so that the candy or other object falls from the cup, and out through the base plunger and the opening in the base portion of the tubular structure. Releasing pressure from either the tubular structure or the base plunger allows the spring to return the dispenser to the hopper cup filling position. As the base plunger and tubular structure are moved relative to one another by the spring, the rack turns the pinion gear and the rotatable hopper back to the rest position, thereby directing the cup towards the storage portion of the tubular structure, which allows additional candy or other objects to enter the cup for dispensing.

As discussed above, the functioning of the dispenser can be reversed by assembling the dispenser with the hopper inverted to direct the cup towards the base portion of the tubular structure in the rest position. Thus, in this embodiment, the rest position is the dispensing position. Pushing the base plunger and the tubular structure together in this embodiment cause the hopper to rotate the cup towards the storage portion of the tubular structure, allowing one or more pieces of candy or other object to be dispensed to fall into the hopper. Releasing the pressure on the base plunger and the tubular structure allows the base plunger to return to the rest position, thereby rotating the hopper to direct the cup towards the base portion of the tubular structure, dispensing the candy or other object.

As will also be recognized by those of ordinary skill in the art, dispenser 10 may have any useful size, where the size of dispenser 10 is preferably determined by the type and size of the objects to be dispensed using dispenser 10. Preferably, tube 14 has an internal diameter of from about 0.25 in. to about 4 in. and a length of from about 2 in. to about 18 in., more preferably an internal diameter of from about 0.5 in. to about 2 in. and a length of from about 2 in. to about 8 in., and, most preferably, an internal diameter of from about 0.75 in. to about 1.25 in. and a length of from about 3.5 in. to about 4.5 in.

The dimensions of base plunger 16 and hopper 12 typically reflect the dimensions of tube 14. Preferably, base plunger 16 has a diameter of from about 0.25 in. to about 4 in. and a length of from about 0.5 in. to about 6 in., more preferably, a diameter of from about 0.6 in. to about 2 in. and a length of from 0.5 in. to about 3 in., and, most preferably, a diameter of from about 0.75 in. to about 1.25 in. and a length of from about 1.5 in. to about 2.5 in.

Similarly, rotatable hopper 12 preferably has a rotational diameter of from about 0.2 in. to about 3.5 in., more preferably from about 0.4 in. to about 1.75 in., and most preferably from about 0.65 in. to about 1.1 in.

Prototypes of dispenser 10 have been constructed with a tube 14 having an internal diameter of about 1 in. and an overall length of about 4 in., a spherical hopper 12 having a diameter of about 0.875 in., a base plunger 16 having a diameter of about 1 in. and a length of about 2 in., and a coil spring 58 having a diameter of about 1 in. and a length of about 0.75 in.

This invention is not limited by the embodiments disclosed herein and it will be appreciated that numerous modifications and embodiments may be devised by those skilled in the art. Therefore, it is intended that the appended claims cover all such modifications and embodiments that fall within the true spirit and scope of the present invention.

What we claim is:

1. A tubular dispenser, comprising:

a rotatable hopper, having an axis of rotation and an outer surface, the rotatable hopper defining a hopper cavity;

a tubular structure, comprising one of a tube or a plurality of interconnected tubes, the tubular structure having a storage portion for storing objects above the rotatable hopper, a base portion, defining a base portion opening for dispensing objects, and a hopper positioning portion, positioned between the storage portion and the base portion, the rotatable hopper positioned within the hopper positioning portion of the tubular structure, such that the rotatable hopper can rotate around the hopper axis of rotation within the hopper positioning portion of the tubular structure;

a tubular base plunger, inserted into the base portion of the tubular structure, and configured to slide over a range of motion within the base portion; and a hopper rotation mechanism functionally connecting the base plunger to the rotatable hopper, wherein the hopper rotation mechanism is configured to rotate the rotatable hopper when the base plunger is moved within the base portion of the tubular structure, and each of the storage portion, the base portion, and the hopper positioning portion is a tube;

wherein the tubular structure comprises an upper tube, comprising the storage portion and the hopper positioning portion;

a tubular rotatable hopper securing piece attached to the hopper positioning portion of the upper dispenser positioning portion; wherein the rotatable hopper is positioned between the hopper positioning portion of the upper tube and the hopper securing piece; and a lower tube, wherein the rotatable hopper, the hopper positioning portion of the upper tube, and the hopper securing piece are inserted into an upper portion of the lower tube to form the tubular structure.

2. The dispenser of claim 1, wherein the hopper rotation mechanism comprises:

a pinion gear, having an axis of rotation, the pinion gear attached to the rotatable hopper, such that the axis of rotation of the hopper is coincident with that of the pinion gear; and a rack attached to the base plunger, and functionally mated to the pinion gear, thereby forming a rack and pinion.

3. The dispenser of claim 1, wherein each of the rotatable hopper and the base plunger have a hopper cup filling position and a dispensing position, such that, when the base plunger is moved within the tubular structure from the hopper cup filling position of the base plunger to the base plunger dispensing position, the hopper rotation mechanism rotates the rotatable hopper from the hopper cup filling position in which the hopper cavity is generally directed towards the tubular structure storage portion to the hopper dispensing position in which the hopper cavity is generally directed towards the tubular structure base portion opening.

4. The dispenser of claim 1, further comprising a base plunger return mechanism.

5. The dispenser of claim 4, wherein the base plunger return mechanism is configured to move the base plunger from a dispensing position to a hopper cup filling position, thereby rotating the rotatable hopper from a hopper dispensing position to a hopper cup filling position.

6. The dispenser of claim 4, wherein the base plunger return mechanism is a spring.

7. The dispenser of claim 6, wherein the spring is a coil spring.

8. The dispenser of claim 6, further comprising an interior tubular structure flange configured to compress the spring as the base plunger is moved towards the dispensing position.

9. The dispenser of claim 1, wherein the base plunger has a range of motion, and the tubular structure and the base plunger each comprise stops configured to limit the range of motion of the base plunger.

10. The dispenser of claim 1, further comprising a removable cap for covering the storage portion.

11. The dispenser of claim 1, wherein the rotatable hopper has a cross section perpendicular to the hopper axis of rotation that is substantially circular.

12. The dispenser of claim 1, wherein the tubular structure comprises at least one of a constriction and an internal flange to position the rotatable hopper within the tubular structure hopper positioning portion.

13. The dispenser of claim 1, further comprising a clearance space between the rotatable hopper and the tubular structure that is sufficiently small to prevent objects stored in the storage portion from entering the clearance space.

14. The dispenser of claim 1, wherein the hopper cavity is sufficiently large to hold a plurality of objects stored in the storage portion of the tubular structure, and to transport the plurality of objects from the storage portion of the tubular structure to the base portion of the tubular structure when the hopper is rotated from a hopper cup filling position to a dispensing position.

15. The dispenser of claim 1, wherein the tubular structure comprises at least a first section and a second section that are connected to form a single tube.

16. The dispenser of claim 1, wherein the tubular structure has a cross section that, at least in part, is substantially circular.

17. The dispenser of claim 1, further comprising a toy portion connected to the storage portion of the tubular structure.

18. The dispenser of claim 17, wherein the toy is attached to or forms a portion of a cap configured to cover the storage portion.

19. A tubular dispenser, comprising:

a rotatable hopper, having an axis of rotation and an inner surface, the rotatable hopper defining a hopper cavity;

a pinion gear, having an axis of rotation, the pinion gear attached to the rotatable hopper, such that the axis of rotation of the hopper is coincident with that of the pinion gear;

a tubular structure, comprising one of a tube or a plurality of interconnected tubes, the tubular structure having a storage portion for storing objects above the rotating hopper, a base portion, and a hopper positioning portion, positioned between the storage portion and the base portion, the tubular structure positioned around the rotatable hopper, such that the rotatable hopper can rotate around the hopper axis of rotation within the hopper positioning portion of the tubular structure;

a tubular base plunger, inserted into the base portion of the tubular structure, and configured to slide over a range of motion within the base portion; and a rack attached to the base plunger, and functionally mated to the pinion gear, thereby forming a rack and pinion configured to rotate the rotatable hopper, wherein each of the storage portion, the base portion, and the hopper positioning portion is a tube;

wherein the tubular structure comprises an upper tube, comprising the storage portion and the hopper positioning portion;

a tubular rotatable hopper securing piece attached to the hopper positioning portion of the upper dispenser positioning portion; wherein the rotatable hopper is positioned between the hopper positioning portion of the upper tube and the hopper securing piece; and a lower tube, wherein the rotatable hopper, the hopper positioning portion of the upper tube, and the hopper securing piece are inserted into an upper portion of the lower tube to form the tubular structure.

20. A tubular dispenser, comprising:

a rotatable hopper, having an axis of rotation and an outer surface, the rotatable hopper defining a hopper cavity;

a tubular structure, comprising an upper tube, having a storage portion for storing objects above the rotatable hopper and a hopper positioning portion, a tubular rotatable hopper securing piece attached to the hopper positioning portion of the upper dispenser positioning portion, and a lower tube, having an upper end and a lower end, the lower end defining a base opening for dispensing objects, and the upper end defining an upper opening into which the rotatable hopper, the hopper positioning portion of the upper tube, and the hopper securing piece are inserted to form the tubular structure, wherein the rotatable hopper is positioned between the hopper positioning portion of the upper tube and the hopper securing piece in the upper end of the lower tube, such that the rotatable hopper can rotate around the hopper axis of rotation between the hopper positioning portion of the tube and the hopper securing piece;

a tubular base plunger, inserted into the lower end of the lower tube, and configured to slide over a range of motion within the lower end of the lower tube; and a hopper rotation mechanism connecting the base plunger to the rotatable hopper, wherein the hopper rotation mechanism is configured to rotate the rotatable hopper when the base plunger is moved within the base portion of the tube;

wherein the tubular structure comprises an upper tube, comprising the storage portion and the hopper positioning portion;

a tubular rotatable hopper securing piece attached to the hopper positioning portion of the upper dispenser positioning portion; wherein the rotatable hopper is positioned between the hopper positioning portion of the upper tube and the hopper securing piece; and a lower tube, wherein the rotatable hopper, the hopper positioning portion of the upper tube, and the hopper securing piece are inserted into an upper portion of the lower tube to form the tubular structure.

* * * * *